US007820599B2

(12) United States Patent
Kasai

(10) Patent No.: US 7,820,599 B2
(45) Date of Patent: Oct. 26, 2010

(54) LUBRICATING OIL COMPOSITION

(75) Inventor: Moritsugu Kasai, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 170 days.

(21) Appl. No.: 11/913,194

(22) PCT Filed: May 25, 2006

(86) PCT No.: PCT/JP2006/310492

§ 371 (c)(1),
(2), (4) Date: Oct. 31, 2007

(87) PCT Pub. No.: WO2006/126651

PCT Pub. Date: Nov. 30, 2006

(65) Prior Publication Data

US 2009/0082233 A1 Mar. 26, 2009

(30) Foreign Application Priority Data

May 27, 2005 (JP) ..... 2005-155520

(51) Int. Cl.
*C10L 1/22* (2006.01)
*C10M 135/18* (2006.01)

(52) U.S. Cl. ..... 508/192; 508/363

(58) Field of Classification Search ..... 508/192, 508/363

See application file for complete search history.

(56) References Cited

U.S. PATENT DOCUMENTS 5,858,931 A * 1/1999 Tanaka et al. ..... 508/364
6,245,725 B1 * 6/2001 Tanaka et al. ..... 508/365

FOREIGN PATENT DOCUMENTS

| | | |
|---|---|---|
| JP | 2001-031984 | 2/2001 |
| JP | 2001-214184 | 8/2001 |
| JP | 2003-041283 | 2/2003 |
| JP | 2003-165991 | 6/2003 |

* cited by examiner

*Primary Examiner*—Walter D Griffin
*Assistant Examiner*—Frank C Campanell
(74) *Attorney, Agent, or Firm*—Oblon, Spivak, McClelland, Maier & Neustadt, L.L.P.

(57) ABSTRACT

A lubricating oil composition includes lubricating oil base oil, an organic molybdenum compound (A), zinc dialkyl dithiophosphate (B), at least one compound (C) selected from calcium sulfonate, calcium phenate, and magnesium sulfonate and having a base number of 230 mgKOH/g or more, and an ashless dispersant containing boron or a mixture of an ashless dispersant containing boron and an ashless dispersant containing no boron (D) in predetermined ratios, in which: a mass ratio (P/Mo) of the P content to the Mo content in the composition is 1.5 or more; a mass ratio (CaMg/Mo) of a total content of the Ca and Mg derived from the component (C) to the Mo content in the composition is 3 or more; and a mass ratio (B/N) between B and N derived from the component (D) in the composition is 0.5 or more. The lubricating oil composition of the present invention has a high static friction coefficient of wet clutch, has excellent frictional property in a power transmission mechanism, has excellent fuel saving property, and is suitably used for power transmission lubricating oil and engine lubricating oil.

6 Claims, No Drawings

LUBRICATING OIL COMPOSITION

CROSS-REFERENCE TO RELATED APPLICATIONS

The present application is a 35 U.S.C. §371 National Stage patent application of International patent application PCT/JP06/310492, filed on May 25, 2006, which claims priority to Japanese patent application JP 2005-155520, filed on May 27, 2005.

TECHNICAL FIELD

The present invention relates to a lubricating oil composition, and more specifically to a lubricating oil composition having a high static friction coefficient of wet clutch, having excellent frictional property in a power transmission mechanism, having excellent fuel saving property, and suitably used for power transmission lubricating oil and engine lubricating oil.

BACKGROUND ART

Engine lubricating oil to be used for a two-wheeled vehicle four-cycle engine differs from four-wheeled vehicle four-cycle engine lubricating oil, and must satisfy properties required for lubrication of both of an engine and a power transmission device, such as a transmission.

For many systems such as two-wheeled vehicles and the like having wet clutch and employing the same oil for engine lubricating oil and power transmission lubricating oil for lubrication, four-wheeled vehicle four-cycle engine lubricating oil is desirably not used as it is. Many improvement studies regarding an engine lubricating oil composition appropriate for a two-wheeled vehicle four-cycle engine are conducted (see Patent Documents 1 and 2, for example).

Vehicle engine lubricating oil must have various properties such as: (1) good detergency; (2) excellent anti-wear property; (3) excellent heat/oxidation stability; (4) small oil consumption; and (5) small engine frictional loss (excellent fuel saving property) in particular, a two-wheeled vehicle has higher engine revolution and higher power with respect to the displacement in normal use compared with those of a four-wheeled vehicle. Further, two-wheeled vehicle engine lubricating oil differs from four-wheeled vehicle engine lubricating oil and is used for lubrication of both of an engine and a power transmission device such as a transmission. Thus, the two-wheeled vehicle engine lubricating oil has an increased oil temperature and must have higher high-temperature detergency compared with that of four-wheeled vehicle engine lubricating oil.

Further, considering the recent environmental issues, in particular, reduction of carbon dioxide emissions, vehicle fuel saving has become an important issue. For vehicle fuel saving, engine lubricating oil requires a fuel saving technique to be applied. For improvement in fuel saving property of a power transmission device such as a transmission, improvement in a power transmission rate and reduction in size and weight are required. From the viewpoints of securing clutch capacity and reduction in weight of the clutch, a friction coefficient between a clutch disc and a clutch plate is required to increase. Thus, the two-wheeled vehicle four-cycle engine lubricating oil is desired to have properties required for engine system lubricating oil, and the power transmission device is desired to have further improved frictional property (high static friction coefficient) of wet clutch.

Patent Document 1: JP 2001-214184 A (page 2)
Patent Document 2: JP 2001-31984 A (page 2)

DISCLOSURE OF THE INVENTION

Problem to be Solved by the Invention

Under such circumstances, an object of the present invention is to provide a lubricating oil composition: having a high static friction coefficient of wet clutch; having excellent frictional property in a power transmission mechanism; having excellent fuel saving property; and suitably used for lubricating both a power transmission and an engine.

Means for Solving the Problem

The inventors of the present invention have conducted intensive studies for developing a lubricating oil composition having the above-mentioned preferred properties. As a result, the inventors of the present invention have found that a composition containing lubricating oil base oil and additives such as an organic molybdenum compound, zinc dialkyl dithiophosphate, a metal-based detergent, and an ashless dispersant containing boron or a mixture of an ashless dispersant containing boron and an ashless dispersant containing no boron in a specific composition may attain the object. The present invention has been completed based on the above findings.

That is, the present invention provides:

(1) A lubricating oil composition characterized by including lubricating oil base oil, an organic molybdenum compound (A) in an Mo content of 100 to 1,000 mass ppm, zinc dialkyl dithiophosphate (B) in a P content of 0.03 to 0.20 mass %, at least one compound (C) selected from calcium sulfonate, calcium phenate, and magnesium sulfonate, wherein a base number obtained through a perchloric acid method is 230 mgKOH/g or more in a Ca and/or Mg content of 0.15 to 0.30 mass %, and an ashless dispersant containing boron or a mixture of an ashless dispersant containing boron and an ashless dispersant containing no boron (D) in a B content of 0.03 mass % or more and an N content of 0.05 mass % or more, in which a mass ratio (P/Mo) of the P content to the Mo content in the composition is 1.5 or more, a mass ratio (CaMg/Mo) of a total content of the Ca and Mg derived from the component (C) to the Mo content in the composition is 3 or more, and a mass ratio (B/N) between B and N derived from the component (D) in the composition is 0.5 or more;

(2) A lubricating oil composition according to the above item (1) in which the organic molybdenum compound as the component (A) includes a molybdenum amine salt and/or molybdenum dithiocarbamate and a mass ratio (MoA/MoD) of an Mo content (MoA) derived from the molybdenum amine salt to an Mo content (MoD) derived from molybdenum dithiocarbamate is 3 or less;

(3) A lubricating oil composition according to the above item (1) or (2), in which the mass ratio (B/N) between B and N derived from the component (D) is 0.5 to 1.2, and the component (D) is included in a B content of 0.03 to 0.2 mass % and an N content of 0.05 to 0.2 mass %; and (4) A lubricating oil composition according to any one of the above items (1) to (3), which is used for lubricating both a power transmission and an engine.

EFFECTS OF THE INVENTION

The present invention can provide a lubricating oil composition: having a high static friction coefficient of wet clutch; having excellent frictional property in a power transmission mechanism; having excellent fuel saving property; and suitably used for power transmission lubricating oil and engine lubricating oil.

BEST MODE FOR CARRYING OUT THE INVENTION

As base oil to be used for a lubricating oil composition of the present invention, mineral oil or synthetic oil is used. The kind of mineral oil or synthetic oil is not particularly limited. However, the mineral oil or synthetic oil has a kinematic viscosity of generally 2 to 50 $mm^2/s$, preferably 3 to 30 $mm^2/s$, and particularly preferably 4 to 25 $mm^2/s$ at 100° C. Mineral oil or synthetic oil having a kinematic viscosity of 2 $mm^2/s$ or more at 100° C. has a small vaporization loss, and mineral oil or synthetic oil having a kinematic viscosity of 50 $mm^2/s$ or less has no excess power loss due to resistance of viscosity and provides a fuel saving effect.

The base oil has a viscosity index of preferably 60 or more, more preferably 80 or more, and particularly preferably 110 or more. Base oil having a viscosity index of 60 or more has small viscosity change due to temperature change.

Examples of the mineral oil include: distilled oil obtained through atmospheric distillation of paraffinic crude oil, intermediate crude oil, or naphthenic crude oil or through reduced-pressure distillation of residual oil from atmospheric distillation; and refined oil obtained through refining of distilled oil following a conventional method such as solvent refined oil, hydrogenation refined oil, dewaxed oil, or clay treated oil.

Examples of the synthetic oil include α-olefin oligomers each having 8 to 14 carbon atoms such as poly(α-olefin), polybutene, polyol ester, and alkyl benzene. In the present invention, one kind of the mineral oil or the synthetic oil may be used as base oil, or two or more kinds thereof may be used in combination. Further, the mineral oil and the synthetic oil may be mixed and used.

In the lubricating oil composition of the present invention, an organic molybdenum compound may be used as component (A). Examples of the organic molybdenum compound include: molybdenum dithiophosphate (MoDTP), molybdenum amine salt, and molybdenum dithiocarbamate (MoDTC). Of those, molybdenum amine salt or molybdenum dithiocarbamate is preferable.

As for the molybdenum amine salt, a reaction product of hexavalent molybdenum compound, such as molybdenum trioxide and/or molybdic acid, and amine compound, for example, the compound obtained by the manufacturing method described in JP-A-2003-252887, may be used.

Examples of the amine compound to be reacted with the hexavalent molybdenum compound include: monoalkyl or monoalkenylamines such as hexylamine, secondary hexylamine, octylamine, secondary octylaime, 2-ethylhexylamine, decylamine, secondary decylamine, dodecylamine, secondary dodecylamine, tetradecylamine, secondary tetradecylamine, hexadecylamine, secondary hexadecylamine, octadecylamine, secondary octadecylamine, and oleylamine; secondary amines such as N-hexylmethylamine, N-secondary hexylmethylamine, N-cyclohexylmethylamine, N-2-ethylhexylmethylamine, N-secondary octylmethylamine, N-decylmethylamine, N-secondary decylmethylamine, N-dodecylmethylamine, N-secondary dodecylmethylamine, N-tetradecylmethylamine, N-hexadecylmethylamine, N-stearylmethylamine, N-oleylmethylamine, dibutylamine, disecondary butylamine, dihexylamine, disecondary hexylamine, dibenzylamine, dioctylamine, bis(2-ethylhexyl) amine, disecondary octylamine, didecylamine, disecondary decylamine, didodecylamine, disecondary dodecylamine, ditetradecylamine, dihexadecylamine, distearylamine, dioleylamine, bis(2-hexyldecyl)amine, bis(2-octyldodecyl) amine, and bis(2-decyltetradecyl)amine;

N-alkyl or alkenyldiamines such as N-butylethylenediamine, N-octylethylenediamine, N-(2-ethylhexyl)ethylenediamine, N-dodecylethylenediamine, N-octadecylethylenediamine, N-butyl-1,3-propanediamine, N-octyl-1,3-propanediamine, N-(2-ethylhexyl)-1,3-propanediamine, N-decyl-1,3-propanediamine, N-dodecyl-1,3-propanediamine, N-tetradecyl-1,3-propanediamine, N-hexadecyl-1,3-propanediamine, N-octadecyl-1,3-propanediamine, N-oleyl-1,3-propanediamine, N-butyl-1,6-hexylenediamine, N-octyl-1,6-hexylenediamine, N-(2-ethylhexyl)-1,6-hexylenediamine, N-dodecyl-1,6-hexylenediamine, N-octadecyl-1,6-hexylenediamine, and N-oleyl-1,6-hexylenediamine;

N-alkyl or alkenylmonoethanolamines such as N-hexylmonoethanolamine, N-octylmonoethanolamine, N-decylmonoethanolamine, N-dodecylonoethanolamine, N-tetradecylmonoethanolamine, N-hexadecylmonoethanolamine, N-octadecylmonoethanolamine, and N-oleylmonoethanolamine; 2-hydroxyalkyl primary amines such as 2-hydroxyhexylamine, 2-hydroxyoctylamine, 2-hydroxydecylamine, 2-hydroxydodecylamine, 2-hydroxytetradecylamine, 2-hydroxyhexadecylamine, and 2-hydroxyoctadecylamine; and N-2-hydroxyalkyl secondary amines such as N-2-hydroxyhexylmethylamine, N-2-hydroxyoctylmethylamine, N-2-hydroxydecylmethylamine, N-2-hydroxytetradecylmethylamine, N-2-hydroxyhexadecylmethylamine, N-2-hydroxyoctadecylmethylamine, N-2-hydroxyhexylethylamine, N-2-hydroxyoctylethylamine, N-2-hydroxydecylethylamine, N-2-hydroxytetradecylethylamine, N-2-hydroxyhexadecylethylamine, N-2-hydroxyoctadecylethylamine, N-2-hydroxyhexylbutylamine, N-2-hydroxyoctylbutylamine, N-2-hydroxydecylbutylamine, N-2-hydroxytetradecylbutylamine, N-2-hydroxyhexadecylbutylamine, and N-2-hydroxyoctadecylbutylamine, N-2-hydroxyhexylmonoethanolamine, N-2-hydroxyoctylmonoethanolamine, N-2-hydroxydecylmonoethanolamine, N-2-hydroxytetradecylmonoethanolamine, N-2-hydroxyhexadecylmonoethanolamine, N-2-hydroxyoctadecylmonoethanolamine, bis(2-hydroxyoctyl) amine, bis(2-hydroxydecyl)amine, bis(2-hydroxydodecyl) amine, bis(2-hydroxytetradecyl)amine, bis(2-hydroxyhexadecyl)amine, and bis(2-hydroxyoctadecyl) amine.

One kind of those amine compounds may be used alone, or two or more kinds thereof may be used in combination.

As a reaction ratio of the hexavalent molybdenum compound to the amine compound, a molar ratio of an Mo atom of the molybdenum compound is preferably 0.7 to 5, more preferably 0.8 to 4, and furthermore preferably 1 to 2.5 with respect to 1 mole of the amine compound. A reaction method is not particularly limited, and a conventional method such as a method described in JP-A-2003-252887 may be employed.

An example of molybdenum dithiocarbamate (MoDTC) may be sulfurized oxymolybdenum dithiocarbamate represented by the general formula (I):

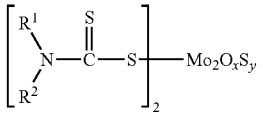

(I)

wherein: $R^1$ and $R^2$ each represent a hydrocarbon group having 4 to carbon atoms; x and y each represent a number of 1 to 3; and a sum of x and y is 4.

Examples of the hydrocarbon group having 4 to 24 carbon atoms include an alkyl group having 4 to 24 carbon atoms, an alkenyl group having 4 to 24 carbon atoms, an aryl group having 6 to 24 carbon atoms, and an arylalkyl group having 7 to 24 carbon atoms. A hydrocarbon group having 4 or more carbon atoms provides favorable solubility in base oil, and a hydrocarbon group having 24 or less carbon atoms provides a favorable effect and is easily available. $R^1$ and $R^2$ mentioned above may be identical to or different from each other.

The alkyl group having 4 to 24 carbon atoms and the alkenyl group having 4 to 24 carbon atoms may be linear, branched, or cyclic. Examples of those groups include an n-butyl group, an isobutyl group, a sec-butyl group, a tert-butyl group, various hexyl groups, various octyl groups, various decyl groups, various dodecyl groups, various tetradecyl groups, various hexadecyl groups, various octadecyl groups, various icosyl groups, cyclopentyl group, cyclohexyl group, oleyl group, and linoleyl group. Furthermore, one or more substituent such as an alkyl group may be attached to the aromatic ring of each of the aryl group having 6 to 24 carbon atoms and the arylalkyl group having 7 to 24 carbon atoms. Examples of those aryl or alkyl groups include a phenyl group, tolyl group, xylyl group, naphthyl group, butylphenyl group, octylphenyl group, nonylphenyl group, benzyl group, methylbenzyl group, butylbenzyl group, phenethyl group, methylphenethyl group, and butylphenethyl group.

In the lubricating oil composition of the present invention, one kind of organic molybdenum compound may be used alone as the component (A), or two or more kinds thereof may be used in combination. The organic molybdenum compound as the component (A) is used in a Mo content within a range of 100 to 1,000 mass ppm. A Mo content of 100 mass ppm or more provides a fuel saving effect, and an Mo content of 1,000 mass ppm or less provides a favorable friction coefficient against a clutch material. The molybdenum compound is used in an Mo content of preferably 200 to 700 mass ppm, and more preferably 400 to 600 mass ppm.

An excessively high content of the molybdenum amine salt degrades fuel saving property, and an excessively high content of molybdenum dithiocarbamate (MoDTC) reduces a friction coefficient against a clutch material. Thus, in the present invention, in view of attaining both fuel saving property and power transmission performance, a mass ratio (MoA/MoD) of an Mo content (MoA) derived from the molybdenum amine salt to an Mo content (MoD) derived from molybdenum dithiocarbamate is preferably 3 or less. The MoD content is preferably 100 to 600 mass ppm, and particularly preferably 200 to 500 mass ppm.

In the lubricating oil composition of the present invention, zinc dialkyl dithiophosphate (ZnDTP) is used as a component (B). An example of zinc dialkyl dithiophosphate is a compound having a structure represented by the general formula (II):

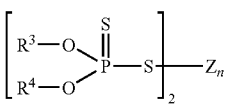

(II)

wherein, $R^3$ and $R^4$ each independently represent a primary or secondary alkyl group having 3 to 22 carbon atoms or an alkylaryl group substituted by an alkyl group having 3 to 18 carbon atoms.

Here, examples of the primary or secondary alkyl group having 3 to 22 carbon atoms include a primary or secondary propyl group, butyl group, pentyl group, hexyl group, octyl group, decyl group, dodecyl group, tetradecyl group, hexadecyl group, octadecyl group, and icosyl group. Furthermore, examples of the alkylaryl group substituted by an alkyl group having 3 to 18 carbon atoms include a propylphenyl group, pentylphenyl group, octylphenyl group, nonylphenyl group, and dodecylphenyl group.

In the lubricating oil composition of the present invention, zinc dialkyl dithiophosphate represented by the general formula (II) may be used alone as the component (B), or two or more kinds thereof may be used in combination. In particular, a lubricating oil composition containing, as a main component, zinc dialkyl dithiophosphate having a secondary alkyl group is preferably used in view of enhancing anti-wear property.

In the lubricating oil composition of the present invention, zinc dialkyl dithiophosphate (ZnDTP) as the component (B) is used in a P content within a range of 0.03 to 0.20 mass %. A P content of 0.03 mass % or more provides favorable anti-wear property and easily develops fuel saving property due to the organic molybdenum compound as the component (A), and a P content of 0.20 mass % or less can suppress catalyst poisoning of an exhaust gas catalyst. Zinc dialkyl dithiophosphate (ZnDTP) is used in a P content of preferably 0.05 to 0.15 mass %, and more preferably 0.07 to 0.12 mass %.

In the lubricating oil composition of the present invention, a mass ratio (P/Mo) of the P content to the Mo content is 1.5 or more, preferably 1.8 or more, and more preferably 2.0 to 5.0. A P/Mo of 1.5 or more can sufficiently realize fuel saving property.

In the lubricating oil composition of the present invention, at least one compound selected from calcium sulfonate, calcium phenate, and magnesium sulfonate and having a base number obtained through a perchloric acid method of 230 mgKOH/g or more is used as a metal-based detergent as a component (C).

With a metal-based detergent having a base number of less than 230 mgKOH/g, the object of the present invention is not sufficiently attained. The base number is preferably 250 mgKOH/g or more, and particularly preferably 300 to 500 mgKOH/g. As overbased calcium sulfonate or magnesium sulfonate like this, alkylbenzene sulfonate having a basic number of 230 mgKOH/g or more and having an alkyl group having 1 to 50 carbon atoms is preferably used. As overbased calcium phenate, alkyl phenate having a basic number of 230 mgKOH/g or more and having an alkyl group having 1 to 50 carbon atoms is preferably used.

In the lubricating oil composition of the present invention, one kind of the metal-based detergent may be used alone as the component (C), or two or more kinds thereof may be used in combination. The metal-based detergent as the component (C) is used in a Ca and/or Mg content within a range of 0.15 to 0.30 mass %. A Ca and/or Mg content of 0.15 mass % or more provides favorable power transmission capability, and a Ca and/or Mg content of 0.30 mass % or less provides favorable fuel saving property. The Ca and/or Mg content is preferably 0.18 to 0.28 mass %.

A mass ratio (CaMg/Mo) of a total content of the Ca and Mg derived from the component (C) to the Mo content must be 3 or more. The mass ratio (CaMg/Mo) of 3 or more provides favorable power transmission capability. The mass ratio (CaMg/Mo) is preferably 4 or more, and particularly preferably within a range of 5 to 10.

In the lubricating oil composition of the present invention, an ashless dispersant containing boron, or a mixture of an ashless dispersant containing boron and an ashless dispersant containing no boron is used as a component (D). Various examples of the ashless dispersant containing boron are present, and examples thereof that can be used include: [1] an ashless dispersant containing boron prepared by treating alkyl or alkenyl succinimide with a boron compound; [2] an ashless dispersant containing boron prepared by treating fatty acid amide with a boron compound; and [3] an ashless dispersant containing boron prepared by treating alkyl or alkenyl benzylamine with a boron compound.

Alkenyl or alkyl succinimide used for the above item [1] refers to succinimide having an alkenyl group or an alkyl group having a molecular weight of about 200 to 4,000, and preferably 500 to 3,000. Typical examples of the alkenyl group or the alkyl group include a polybutenyl group and a polyisobutenyl group. The polybutenyl group used herein is prepared by polymerizing a mixture of 1-butene and isobutene or high-purity isobutene, or by hydrogenating a polyisobutenyl group.

A method of producing polybutenyl succinimide may employ an arbitrary conventional method. For example, polybutenyl succinimide may be obtained by: reacting polybutene or chlorinated polybutene each having a molecular weight of about 200 to 4,000 with maleic anhydride at about 100 to 200° C.; and reacting the thus-obtained polybutenyl succinimide with polyamine.

Examples of polyamine include diethylenetriamine, triethylenetetramine, tetraethylenepentamine, and pentaethylene hexamine.

Next, a method of producing succinimide containing boron may employ a conventional method. For example, succinimide containing boron may be obtained by: adding polyamine mentioned above, polybutenyl succinic acid (anhydride), and a boron compound such as boric acid to an organic solvent such as alcohols, hexane, or xylene; and heating the whole under appropriate conditions.

Alkenyl or alkyl succinimide may preferably employ alkylphenol or a sulfurized alkyl phenol derivative each prepared through Mannich condensation of alkenyl or alkyl succinimide and an aromatic compound such as alkyl phenol or sulfurized alkyl phenol. Alkyl phenol to be used has an alkyl group generally having 3 to 30 carbon atoms.

Fatty acid amide used for the above item [2] is obtained from a fatty acid and polyamine, and a saturated or unsaturated straight-chain or branched carboxylic acid having 8 to 24 carbon atoms is preferably used as the fatty acid. The same polyamine as that used for the above item [1] is used.

The same alkenyl or alkyl group as that used for the above item [3] is used for alkenyl or alkyl benzylamine used for the above item [3]. Examples of the boron compound to be used for the above items [1] to [3] include boric acid, boric anhydride, halogenated boron, borate ester, boramide, and boron oxide. Of those, boric acid is particularly preferred.

Of the ashless dispersant containing boron, succinimide containing boron prepared by treating alkenyl or alkyl succinimide with a boron compound is particularly preferred.

Meanwhile, examples of the ashless dispersant containing no boron that may be used include the above-mentioned alkyl or alkenyl succinimide, fatty acid amide, and alkyl or alkenyl benzylamine.

In the lubricating oil composition of the present invention, a mixture of at least one ashless dispersant containing boron and at least one ashless dispersant containing no boron may be used as the component (D).

Zinc dialkyl dithiophosphate (ZnDTP) and an ashless dispersant such as polybutenyl succinimide to be mixed into the lubricating oil composition each have a function of increasing a friction coefficient between a clutch disc and a clutch plate. However, in the case where both additive are mixed and used such as in an engine oil composition, zinc dialkyl dithiophosphate interacts with a basic amine site of the ashless dispersant, and thus an effect of increasing a friction coefficient between a clutch disc and a clutch plate is lost.

Thus, the inventors of the present invention have conducted intensive studies, and have found that modification of the ashless dispersant with a boron compound protects a basic amine site with the boron compound and reduces interaction with zinc dialkyl dithiophosphate, to thereby develop a function of increasing a friction coefficient between a clutch disc and a clutch plate.

In the present invention, in order to develop such a function effectively, a mass ratio (B/N) between B and N derived from the component (D) must be 0.5 or more, preferably 0.6 or more, and more preferably 0.6 to 1.2.

Further, in order to develop such a function effectively, the component (D) in the lubricating oil composition of the present invention must be used in a B content of 0.03 mass % or more and an N content of 0.05 mass % or more. An upper limit for the B content is not particularly limited, but is about 0.2 mass % in view of storage stability. The B content is preferably 0.04 to 0.1 mass %.

Meanwhile, the N content is preferred to be small in order to increase a friction coefficient, but if the N content is less than 0.05 mass % then the detergency significantly degrades. An upper limit for the N content is not particularly limited, but is about 0.2 mass % for providing favorable demulsifying property.

The lubricating oil composition of the present invention may mix other additives as required within a range not inhibiting the object of the present invention.

Examples of the other additives include: a metal-based detergent excluding the component (C); a hindered phenol-based, amine-based, phosphate-based, etc. antioxidant; an anti-wear agent or extreme pressure agent excluding the component (A) and the component (B) such as a sulfur-based (such as sulfides, sulfoxides, sulfones, or thiophosphinates), halogen-based (such as chlorinated hydrocarbon), or organic metal-based anti-wear agent or extreme pressure agent; a viscosity index improver or pour point depressant such as polymethacrylate, an olefin copolymer, or polybutene; and a rust inhibitor, a corrosion inhibitor, and an antifoaming agent.

The lubricating oil composition of the present invention having such a composition has a high static friction coefficient of wet clutch, has excellent frictional property in a power transmission mechanism, has excellent fuel saving property, and is suitably used for both power transmission lubricating oil and engine lubricating oil of two-wheeled vehicle, for example.

EXAMPLES

Next, the present invention will be described more specifically by way of examples, but the present invention is not limited to the examples in any way.

Note that evaluation of a lubricating oil composition was performed following the method described below.

<Friction Property Test>

A friction coefficient of sample oil was measured under the following conditions by using an oscillation dynamic friction testing machine (SRV) ["SRVIII", available from Optimol Instruments Prüftechnik GmbH], and fuel saving property was evaluated.

(1) Test piece: (a) disc SUJ2 material, (b) cylinder SUJ2 material (2) Amplitude: 1.5 mm (3) Frequency: 50 Hz (4) Load: 400 N (5) Temperature: 80° C.

<Clutch Frictional Property>

Performance classification of clutch frictional property is defined in JASO two-wheeled four-cycle engine oil standards (JASO T903-98).

A test was performed in accordance with JASO T904-98, which is a clutch frictional property testing method, and a dynamic friction index (DFI), a static friction index (SFI), and stop time index (STI) were calculated. A sample having the respective indices of 1.45 or more, 1.15 or more, and 1.55 or more is classified as MA performance having a high friction coefficient of clutch and excellent power transmission capability.

Examples 1 to 6 and Comparative Examples 1 to 7

Lubricating oil compositions having mixed compositions shown in Table 1 (Examples 1 to 6) and Table 2 (Comparative Examples 1 to 7) were prepared, and performances of the lubricating oil compositions were evaluated. Table 1 and Table 2 show the results.

TABLE 1

| | | | | Example | | |
|---|---|---|---|---|---|---|
| | | | | 1 | 2 | 3 |
| Mixed composition (mass %) | Lubricating oil base oil[1)] | | | Remainder | Remainder | Remainder |
| | ZnDTP (P content)[2)] | | | 0.100 | 0.100 | 0.100 |
| | MoDTC (Mo content)[3)] | | | 0.050 | 0.050 | 0.050 |
| | Mo amine salt (Mo content)[4)] | | | — | — | — |
| | 300TBN | Ca sulfonate (Ca content)[5)] | | 0.190 | 0.150 | 0.190 |
| | | Mg sulfonate (Mg content)[6)] | | — | — | 0.060 |
| | | Ca phenate (Ca content)[7)] | | 0.060 | 0.060 | — |
| | 80TBN Ca sulfonate (Ca content)[8)] | | | — | — | — |
| | 20TBN Ca sulfonate (Ca content)[9)] | | | — | 0.040 | — |
| | Boron-modified succinimide | A[10)] | (B content) | 0.040 | 0.040 | 0.040 |
| | | | (N content) | 0.035 | 0.035 | 0.035 |
| | | B[11)] | (B content) | — | — | — |
| | | | (N content) | — | — | — |
| | | C[12)] | (B content) | — | — | — |
| | | | (N content) | — | — | — |
| | Succinimide D (N content)[13)] | | | 0.024 | 0.024 | 0.024 |
| | Succinimide E (N content)[14)] | | | — | — | — |
| | Other additives[15)] | | | 7.0 | 7.0 | 7.0 |
| Composition (mass %) | 300TBN (Ca + Mg content)[16)] | | | 0.250 | 0.210 | 0.250 |
| | Total Mo content | | | 0.050 | 0.050 | 0.050 |
| | P content | | | 0.100 | 0.100 | 0.100 |
| | B content | | | 0.040 | 0.040 | 0.040 |
| | N content derived from imide[17)] | | | 0.059 | 0.059 | 0.059 |
| (Ca + Mg)/Mo mass ratio in composition[18)] | | | | 5.0 | 4.2 | 5.0 |
| P/Mo mass ratio in composition | | | | 2.0 | 2.0 | 2.0 |
| Mo ratio of Mo amine salt/MoDTC | | | | — | — | — |
| B/N mass ratio derived from imide in composition[19)] | | | | 0.68 | 0.68 | 0.68 |
| Clutch frictional property | JASO classification[20)] | | | MA | MA | MA |
| | DFI (Dynamic friction index) | | | 1.75 | 1.70 | 1.72 |
| | SFI (Static friction index) | | | 1.35 | 1.29 | 1.33 |
| | STI (Stop time index) | | | 1.68 | 1.63 | 1.65 |
| Friction coefficient SRV [80° C.] | | | | 0.05 | 0.05 | 0.05 |

| | | | | Example | | |
|---|---|---|---|---|---|---|
| | | | | 4 | 5 | 6 |
| Mixed composition (mass %) | Lubricating oil base oil[1)] | | | Remainder | Remainder | Remainder |
| | ZnDTP (P content)[2)] | | | 0.100 | 0.100 | 0.100 |
| | MoDTC (Mo content)[3)] | | | 0.028 | 0.050 | 0.050 |
| | Mo amine salt (Mo content)[4)] | | | 0.022 | — | — |
| | 300TBN | Ca sulfonate (Ca content)[5)] | | 0.190 | 0.190 | 0.250 |
| | | Mg sulfonate (Mg content)[6)] | | — | — | — |
| | | Ca phenate (Ca content)[7)] | | 0.060 | 0.060 | — |
| | 80TBN Ca sulfonate (Ca content)[8)] | | | — | — | — |
| | 20TBN Ca sulfonate (Ca content)[9)] | | | — | — | — |
| | Boron-modified succinimide | A[10)] | (B content) | 0.040 | — | 0.060 |
| | | | (N content) | 0.035 | — | 0.053 |
| | | B[11)] | (B content) | — | 0.034 | — |
| | | | (N content) | — | 0.041 | — |

TABLE 1-continued

| | | | | | |
|---|---|---|---|---|---|
| | | C[12] (B content) | — | — | 0.019 |
| | | (N content) | — | — | 0.024 |
| | Succinimide D (N content)[13] | | 0.024 | 0.024 | — |
| | Succinimide E (N content)[14] | | — | — | 0.010 |
| | Other additives[15] | | 7.0 | 7.0 | 7.0 |
| Composition (mass %) | 300TBN (Ca + Mg content)[16] | | 0.250 | 0.250 | 0.250 |
| | Total Mo content | | 0.050 | 0.050 | 0.050 |
| | P content | | 0.100 | 0.100 | 0.100 |
| | B content | | 0.040 | 0.034 | 0.079 |
| | N content derived from imide[17] | | 0.059 | 0.065 | 0.087 |
| (Ca + Mg)/Mo mass ratio in composition[18] | | | 5.0 | 5.0 | 5.0 |
| P/Mo mass ratio in composition | | | 2.0 | 2.0 | 2.0 |
| Mo ratio of Mo amine salt/MoDTC | | | 0.8 | — | — |
| B/N mass ratio derived from imide in composition[19] | | | 0.68 | 0.52 | 0.91 |
| Clutch frictional property | JASO classification[20] | | MA | MA | MA |
| | DFI (Dynamic friction index) | | 1.80 | 1.69 | 1.82 |
| | SFI (Static friction index) | | 1.38 | 1.30 | 1.56 |
| | STI (Stop time index) | | 1.75 | 1.63 | 1.81 |
| Friction coefficient SRV [80° C.] | | | 0.06 | 0.05 | 0.05 |

[Notice]

[1]Paraffinic mineral oil, kinematic viscosity at 100° C. 5.285 $mm^2/s$, viscosity index 104

[2]Secondary alkyl-type zinc dialkyl dithiophosphate, P content 8.6 mass %

[3]Molybdenum dithiocarbamate, manufactured by ADEKA, Co., Ltd, trade name "SAKURALUB 155", Mo content 4.5 mass %

[4]Molybdenum amine salt, manufactured by ADEKA, Co., Ltd, trade name "SAKURALUB 700", Mo content 4.5 mass %

[5]Calcium sulfonate, base number obtained through a perchloric acid method (TBN) 300 mgKOH/g, Ca content 12.5 mass %

[6]Magnesium sulfonate, base number obtained through a perchloric acid method (TBN) 300 mgKOH/g, Mg content 9.3 mass %

[7]Calcium phenate, base number obtained through a perchloric acid method (TBN) 300 mgKOH/g, Ca content 10.0 mass %

[8]Calcium sulfonate, base number obtained through a perchloric acid method (TBN) 80 mgKOH/g, Ca content 4.8 mass %

[9]Calcium sulfonate, base number obtained through a perchloric acid method (TBN) 20 mgKOH/g, Ca content 2.4 mass %

[10]N content 1.8 mass %, B content 2.0 mass %

[11]N content 2.3 mass %, B content 1.9 mass %

[12]N content 0.7 mass %, B content 0.2 mass %

[13]Polybutenyl imide succinate, N content 1.0 mass %, free of B

[14]Polybutenyl imide succinate, N content 1.2 mass %, free of B

[15]Viscosity index improver, pour point depressant, antioxidant, antifoaming agent, corrosion inhibitor, and the like

[16]Total amount of Ca content and Mg content each derived from Ca sulfonate, Mg sulfonate, or Ca phenate of 300 TBN in a composition

[17]Total N content derived from boron-modified imide succinate and imide succinate (not modified with boron) in a composition

[18](Ca + Mg): 300 TBN (Ca + Mg amount)

[19]Mass ratio (B/N) between B and N derived from boron-modified imide succinate and imide succinate (not modified with boron) in a composition

[20]JASO T904-98

TABLE 2

| | | | Comparative example | | | |
|---|---|---|---|---|---|---|
| | | | 1 | 2 | 3 | 4 |
| Mixed composition (mass %) | Lubricating oil base oil[1] | | Remainder | Remainder | Remainder | Remainder |
| | ZnDTP (P content)[2] | | 0.100 | 0.100 | 0.100 | 0.100 |
| | MoDTC (Mo content)[3] | | 0.050 | 0.050 | 0.050 | 0.050 |
| | Mo amine salt (Mo content)[4] | | — | — | — | — |
| | 300TBN | Ca sulfonate (Ca content)[5] | 0.080 | 0.140 | 0.140 | 0.190 |
| | | Mg sulfonate (Mg content)[6] | — | — | — | — |
| | | Ca phenate (Ca content)[7] | 0.060 | — | — | 0.060 |
| | 80TBN Ca sulfonate (Ca content)[8] | | 0.060 | — | 0.110 | — |
| | 20TBN Ca suifonate (Ca content)[9] | | — | 0.110 | — | — |
| | Boron-modified succinimide | A[10] (B content) | 0.040 | 0.040 | 0.040 | 0.020 |
| | | (N content) | 0.035 | 0.035 | 0.035 | 0.018 |
| | | B[11] (B content) | — | — | — | — |
| | | (N content) | — | — | — | — |
| | | C[12] (B content) | — | — | — | — |
| | | (N content) | — | — | — | — |
| | Succinimide D (N content)[13] | | 0.024 | 0.024 | 0.024 | 0.024 |
| | Succinimide E (N content)[14] | | — | — | — | — |
| | Other additives[15] | | 7.0 | 7.0 | 7.0 | 7.0 |
| Composition (mass %) | 300TBN (Ca + Mg content)[16] | | 0.140 | 0.140 | 0.140 | 0.250 |
| | Total Mo content | | 0.050 | 0.050 | 0.050 | 0.050 |
| | P content | | 0.100 | 0.100 | 0.100 | 0.100 |
| | B content | | 0.040 | 0.040 | 0.040 | 0.020 |
| | N content derived from imide[17] | | 0.059 | 0.059 | 0.059 | 0.042 |
| (Ca + Mg)/Mo mass ratio in composition[18] | | | 2.8 | 2.8 | 2.8 | 5.0 |
| P/Mo mass ratio in composition | | | 2.0 | 2.0 | 2.0 | 2.0 |

TABLE 2-continued

| | | | | | |
|---|---|---|---|---|---|
| Mo ratio of Mo amine salt/MoDTC | | — | — | — | — |
| B/N mass ratio derived from imide in composition[19] | | 0.68 | 0.68 | 0.68 | 0.48 |
| Clutch frictional property | JASO classification[20] | MB | MB | MB | MB |
| | DFI (Dynamic friction index) | 1.32 | 1.31 | 1.25 | 1.32 |
| | SFI (Static friction index) | 1.10 | 1.15 | 1.10 | 1.12 |
| | STI (Stop time index) | 1.42 | 1.43 | 1.36 | 1.54 |
| Friction coefficient SRV [80° C.] | | 0.05 | 0.05 | 0.05 | 0.05 |

| | | | | Comparative example | | |
|---|---|---|---|---|---|---|
| | | | | 5 | 6 | 7 |
| Mixed composition (mass %) | Lubricating oil base oil[1] | | | Remainder | Remainder | Remainder |
| | ZnDTP (P content)[2] | | | 0.020 | — | 0.100 |
| | MoDTC (Mo content)[3] | | | 0.050 | 0.050 | 0.005 |
| | Mo amine salt (Mo content)[4] | | | — | — | 0.001 |
| | 300TBN | Ca sulfonate (Ca content)[5] | | 0.190 | 0.190 | 0.190 |
| | | Mg sulfonate (Mg content)[6] | | — | — | — |
| | | Ca phenate (Ca content)[7] | | 0.060 | 0.060 | 0.060 |
| | 80TBN Ca sulfonate (Ca content)[8] | | | — | — | — |
| | 20TBN Ca sulfonate (Ca content)[9] | | | — | — | — |
| | Boron-modified succinimide | A[10] | (B content) | 0.040 | 0.040 | 0.040 |
| | | | (N content) | 0.035 | 0.035 | 0.035 |
| | | B[11] | (B content) | — | — | — |
| | | | (N content) | — | — | — |
| | | C[12] | (B content) | — | — | — |
| | | | (N content) | — | — | — |
| | Succinimide D(N content)[13] | | | 0.024 | 0.024 | 0.024 |
| | Succinimide E(N content)[14] | | | — | — | — |
| | Other additives[15] | | | 7.0 | 7.0 | 7.0 |
| Composition (mass %) | 300TBN(Ca + Mg content)[16] | | | 0.250 | 0.250 | 0.250 |
| | Total Mo content | | | 0.050 | 0.050 | 0.006 |
| | P content | | | 0.020 | — | 0.100 |
| | B content | | | 0.040 | 0.040 | 0.040 |
| | N content derived from imide[17] | | | 0.059 | 0.059 | 0.059 |
| (Ca + Mg)/Mo mass ratio in composition[18] | | | | 5.0 | 5.0 | 50.0 |
| P/Mo mass ratio in composition | | | | 0.4 | — | 20.0 |
| Mo ratio of Mo amine salt/MoDTC | | | | — | — | 0.2 |
| B/N mass ratio derived from imide in composition[19] | | | | 0.68 | 0.68 | 0.68 |
| Clutch frictional property | JASO classification[20] | | | MA | MA | MA |
| | DFI (Dynamic friction index) | | | 1.85 | 2.02 | 1.95 |
| | SFI (Static friction index) | | | 1.56 | 1.95 | 1.88 |
| | STI (Stop time index) | | | 1.80 | 1.98 | 1.93 |
| Friction coefficient SRV [80° C.] | | | | 0.10 | 0.15 | 0.11 |

[Notice]
Footnotes [1] to [20] are the same as those described for Table 1.

The results of Table 1 reveal that the compositions of Examples 1 to 6, which are lubricating oil compositions of the present invention, each have high friction indices and excellent fuel saving property.

In contrast, the lubricating oil compositions of Comparative Examples each have the following problems.

The compositions of Comparative Examples 1 to 3 each having a low 300 TBN ($Ca^+$ Mg content) and the composition of Comparative Example 4 having a low N content derived from imide etc. each have low friction indices and insufficient power transmission capability. Further, the compositions of Comparative Examples 5 and 6 each having a small P/Mo mass ratio in the composition and the composition of Comparative Example 7 having a low organic molybdenum compound content (Mo content of 60 mass ppm) each have degraded fuel saving property.

INDUSTRIAL APPLICABILITY

The lubricating oil composition of the present invention has a high static friction coefficient of wet clutch, has excellent frictional property in a power transmission mechanism, has excellent fuel saving property, and is suitably used for lubricating both a power transmission and an engine.

The invention claimed is:

1. A lubricating oil composition comprising:

a lubricating oil base oil;

an organic molybdenum compound (A) having a Mo content of 100 to 1,000 mass ppm;

zinc dialkyl dithiophosphate (B) having a P content of 0.03 to 0.20 mass %;

at least one compound (C) selected from calcium sulfonate, calcium phenate, and magnesium sulfonate and having a base number obtained through a perchloric acid method of 230 mgKOH/g or more in a Ca and/or Mg content of 0.15 to 0.30 mass %; and an ashless dispersant comprising boron, or a mixture of an ashless dispersant comprising boron and an ashless dispersant comprising no boron (D) in a B content of 0.03 mass % or more and an N content of 0.05 mass % or more, wherein:

a mass ratio (P/Mo) of the P content to the Mo content in the composition is 1.5 or more;

a mass ratio (CaMg/Mo) of a total content of the Ca and Mg derived from the component (C) to the Mo content in the composition is 3 or more; and a mass ratio (B/N) between B and N derived from the component (D) in the composition is 0.5 or more.

2. The lubricating oil composition according to claim 1, wherein:

the organic molybdenum compound as the component (A) comprises a molybdenum amine salt and molybdenum dithiocarbamate; and a mass ratio (MoA/MoD) of an Mo content (MoA) derived from the molybdenum amine salt to an Mo content (MoD) derived from molybdenum dithiocarbamate is 3 or less.

3. The lubricating oil composition according to claim 1, wherein:

the mass ratio (B/N) between B and N derived from the component (D) is 0.5 to 1.2; and the component (D) is included in a B content of 0.03 to 0.2 mass % and an N content of 0.05 to 0.2 mass %.

4. A power transmission lubricant comprising the lubricating oil composition according to claim 1.

5. An engine lubricant comprising the lubricating oil composition according to claim 1.

6. A method for improving static friction coefficient of a wet clutch comprising adding the lubricating oil composition according to claim 1 to a power transmission containing the wet clutch.

* * * * *